United States Patent [19]

Satake et al.

[11] Patent Number: 4,918,044

[45] Date of Patent: Apr. 17, 1990

[54] THERMOSENSITIVE RECORDING SHEET

[75] Inventors: Toshimi Satake; Toshiaki Minami; Fumio Fujimura, all of Tokyo; Satoshi Oda, Ikoma; Masato Magami, Nakatsu, all of Japan

[73] Assignees: Jujo Paper Co., Ltd., Tokyo; Yoshitomi Pharmaceutical Industries, Ltd., Osaka, both of Japan

[21] Appl. No.: 188,376

[22] Filed: Apr. 29, 1988

[30] Foreign Application Priority Data

Apr. 30, 1987 [JP] Japan ..... 62-107841

[51] Int. Cl.[4] ..... B41M 5/18

[52] U.S. Cl. ..... 503/209; 427/150; 427/151; 503/208; 503/216; 503/217; 503/220; 503/221; 503/225

[58] Field of Search ..... 427/150–152; 428/913, 914; 503/208, 209, 216, 217, 220, 221, 225

[56] References Cited

U.S. PATENT DOCUMENTS 4,471,073 9/1984 Ikeda et al. ..... 503/209

4,480,052 10/1984 Ichijima et al. ..... 503/209

*Primary Examiner*—Bruce H. Hess

[57] ABSTRACT

A thermosensitive recording sheet having a thermosensitive color developer layer containing a basic leuco dye and an organic color developer, said layer containing a compound of the formula

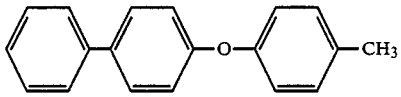

(I)

as a sensitizer.

7 Claims, No Drawings

THERMOSENSITIVE RECORDING SHEET

This invention relates to a thermosensitive recording sheet, and more specifically, to a thermosensitive recording sheet which is suitable for high density and high-speed recording and has excellent image stability.

Thermosensitive recording sheets which utilize a coloring reaction under heat between a normally colorless or light-colored basic leuco dye and an organic color developer such as phenols and organic acids are disclosed, for example, in Japanese Patent Publication No. 14039/1970 and Japanese Laid-Open Patent Publication No. 27736/1973, and have gained widespread commercial acceptance. Generally, the thermosensitive recording sheets are obtained by grinding the colorless to light-colored basic leuco dye and the organic color developer into fine particles, mixing these particles, adding a binder, a filler, a sensitivity increasing agent, a lubricant and other auxiliary agents to the mixture to form a coating composition, and applying the coating composition in a thin layer to a support such as paper or a plastic film. The thermosensitive color developer layer forms a color imagewise by an instantaneous chemical reaction induced by heating and thereby permits recording of the image. Images of various colors can be obtained by properly selecting the type of the leuco dye.

These thermosensitive recording sheets have been finding applications, for example, in measuring and recording instruments in the medical or industrial field, terminal devices of computers and information communication devices, facsimile devices, printers of electronic portable calculators, and automatic ticket vendors.

In recent years, the thermosensitive recording method has gained widespread acceptance and found a diversity of applications, and it has been considered important to increase not only the speed of recording but also the density of recording for higher resolution or enhanced image quality. As a result, the thermal energy of a thermal printhead in a recording device tends to become increasingly low, and therefore, thermosensitive recording sheets used in it are required to have color forming sensitivity sufficient to obtain clear recorded color images even when the amount of thermal energy is low.

Many substances are described in various literature references including Japanese Patent Publication No. 14039/1970 as color developers for thermosensitive recording sheets, but 4,4'-isopropylidene diphenol (bisphenol A) is now used most widely because of its stable quality, cost and availability. However, since bisphenol A has a high heat color-developing temperature, it cannot fully adapt to recording by a small amount of thermal energy, and troubles such as sticking tend to occur.

In an attempt to meet the recent requirements for higher recording speeds and higher image quality, Japanese Laid-Open Patent Publication No. 144193/1981 proposes a thermosensitive recording sheet including p-hydroxybenzoic acid ester as a color developer used in combination with a fluorane-type dye, and makes it clear that higher sensitivity with excellent dynamic color developability can be easily achieved by this thermosensitive recording sheet. But the thermosensitive recording sheet containing the p-hydroxybenzoic acid ester as a color developing agent has the defect that the density of an image formed by application of heat decreases with time, the so-called "crystallization" phenomenon occurs whereby crystals precipitate onto the surface of the image, and that the image area does not have sufficient stability to oily substances.

The use of monophenolsulfone compounds as the color developer was recently disclosed in Japanese Laid-Open Patent Publications Nos. 20493/1983, 82788/1983, 132593/1983, and 166098/1983. However, thermosensitive recording sheets comprising the monophenolsulfone compounds as the color developer still cannot fully respond to the aforesaid recording by a small amount of thermal energy, and cannot give as high dynamic recording densities as the thermosensitive recording sheets containing the p-hydroxybenzoic acid esters as the color developer.

It is also known that to provide a thermosensitive recording sheet having color sensitivity colored recording even with a small amount of thermal energy an additional component, typically waxes (Japanese Patent Publication No. 27599/1976), and also such compounds as phenol derivatives (Japanese Laid-Open Patent Publications Nos. 57989/1983 and 187590/1985) and phenyl ether derivatives (Japanese Laid-Open Patent Publication No. 187590/1985), is incorporated in a thermosensitive color developing layer. The addition of such third components, however, has not produced fully satisfactory results.

Furthermore, on long-term storage, the recorded images may discolor or fade under external influences such as light, humidity and heat, and the background portion undergoes "backgrounding" whereby it is colored undesirably.

Japanese Laid-Open Patent Publications Nos. 45747/1974, 18752/1979 and 83495/1982 describe that phenolic antioxidants effectively act as stabilizers for improving the preservability of recorded images. The use of a large amount of such a stabilizer, however, tends to reduce the color developing sensitivity of the recording sheets because of its diluting effect.

It is an object of this invention to provide a thermosensitive recording sheet capable of giving a clear and stable color image having a sufficiently high dynamic image density.

Another object of this invention is to provide a thermosensitive recording sheet which can form a clear and stable dye image having a sufficiently high dynamic image density and excellent long-term preservability and undergoing little discoloration and fading by moisture, heat, etc., and which is free from backgrounding.

Further objects and advantages of this invention will become apparent from the following description.

According to this invention, there is provided a thermosensitive recording sheet having a thermosensitive color developing layer containing a basic leuco dye and an organic color developer, said layer containing a compound of the formula

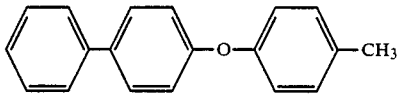

(I)

as a sensitizer.

The compound of formula (I) is a known compound, 4-biphenyl p-tolyl ether, having a melting point of 96° to 98° C. It can be obtained easily in a good yield by condensation of p-phenylphenol and p-bromotoluene as shown in Synthesis Example given hereinafter.

When the compound of formula (I) is incorporated in a thermosensitive color developing layer containing a basic leuco dye and an organic color developer in accordance with the present invention, the speed of melting, dissolving and diffusing of the color developer in the compound of formula (I) and its saturation solubility are very high. Furthermore, the speed of melting, dissolving and diffusing of the dye in the compound (I) and its saturation solubility are also high. For this reason, when the thermosensitive recording sheet is heated, the organic color developer, the compound of formula (I) and the leuco dye rapidly react physicochemically to instantaneously form a colored composition. Since the colored composition is very stable to moisture and heat, the thermosensitive recording sheet of this invention gives colored image which have a sufficient dynamic color density and excellent long-term storage stability, do not fade upon contact with moisture and heat, are free from backgrounding and have excellent stability.

The compound of formula (I) which leads to these advantages is conveniently used in an amount of generally 3 to 12 parts by weight, preferably 1 to 5 parts by weight, more preferably 2 to 4 parts by weight, per part by weight of the basic leuco dye in the thermosensitive color developing layer.

The "basic leuco dye" used in the thermosensitive recording sheet of this invention is a basic dye having the property of being normally colorless or light-colored but upon contact with the aforesaid color developers under heat, forming a color. There is no particular restriction on the basic leuco dye used in this invention and any basic leuco dyes heretofore used in thermosensitive recording sheets can equally be used. generally, leuco dyes of the triphenylmethane, fluorane and azaphthalide types are preferred. Specific examples are shown below.

Triphenylmethane-type leuco dyes 3,3-bis(p-Dimethylaminophenyl)-6-dimethylaminophthalide (also called Crystal Violet Lactone).

Fluorane-type leuco dyes

3-Diethylamino-6-methyl-7-anilinofluorane,
3-(N-ethyl-p-toluidino)-6-methyl-7-anilinofluorane,
3-(N-ethyl-N-isoamyl)amino-6-methyl-7-anilinofluorane,
3-diethylamino-6-methyl-7-(o,p-dimethylanilino)fluorane,
3-pyrrolidino-6-methyl-7-anilinofluorane,
3-piperidino-6-methyl-7-anilinofluorane,
3-(N-cyclohexyl-N-methylamino)-6-methyl-7-anilinofluorane,
3-diethylamino-7-(m-trifluoromethylanilino)fluorane,
3-N-n-dibutylamino-7-(o-chloroanilino)fluorane,
3-(N-ethyl-N-tetrahydrofurylamino)-6-methyl-7-anilinofluorane,
3-dibutylamino-6-methyl-7-(o,p-dimethylanilino)fluorane,
3-(N-methyl-N-propylamino)-6-methyl-7-anilinofluorane,
3-diethylamino-6-chloro-7-anilinofluorane,
3-dibutylamino-7-(o-chloroanilino)fluorane,
3-diethylamino-6-methyl-chlorofluorane,
3-diethylamino-6-methyl-fluorane,
3-cyclohexylamino-6-chlorofluorane,
3-diethylamino-7-(o-chloroanilino)fluorane, and
3-diethylamino-benzo[a]-fluorane.

Azaphthalide-type leuco dyes 3-(4-Diethylamino-2-ethoxyphenyl)-3-(1-ethylmethylindol-3-yl)-4-azaphthalide,
3-(4-diethylamino-2-ethoxyphenyl)-3-(1-ethyl-ethylindol-3-yl)-7-azaphthalide,
3-(4-diethylamino-2-ethoxyphenyl)-3-(1-octyl-ethylindol-3-yl)-4-azaphthalide, and
3-(4-N-cyclohexyl-N-methylamino-2-methoxyphenyl)-3-(1-ethyl-2-methylindol-3-yl)-4-azaphthalide.

Fluorein-type leuco dyes 3,6,6'-tris(dimethylamino)spiro[fluorein-9,3'-phthalide], and
3,6,6'-tris(diethylamino)spiro[fluorein-9,3'-phthalide].

Of the basic leuco dyes described above, triphenylmethane-type, fluorane-type dyes and azaphthalide-type dyes are preferred.

These dyes may also be used singly or in combination. In the present invention, a thermosensitive recording sheet having a markedly high dynamic image density can be obtained by using 3-diethylamino-6-methyl-7-anilinofluorane, 3-(N-cyclohexyl-N-methylamino)-6-methyl-7-anilinofluorane, 3-(N-ethyl-N-isoamyl)amino-6-methyl-7-anilinofluorane and 3-(4-diethylamino-2-ethoxyphenyl)-3-(1-ethyl-2-methylindol-3-yl)-4-azaphthalide singly as the basic leuco dye.

A thermosensitive recording sheet having excellent oil resistance and storage stability and a high dynamic image density can be obtained when a mixture of 3-diethylamino-6-methyl-7-anilinofluorane and 3-(N-cyclohexyl-N-methylamino)-6-methyl-7-anilinofluorane is used as the basic leuco dye.

The organic color developers that can be used in the thermosensitive color developing layer in accordance with this invention may be any organic color developer heretofore used in the thermosensitive color developing layer of a thermosensitive recording sheet. Examples include bisphenol A compounds, 4-hydroxybenzoic acid esters, 4-hydroxyphthalic acid diesters, phthalic acid monoesters, bis-(hydroxyphenyl) sulfides, 4-hydroxyphenylarylsulfones, 4-hydroxyphenylarylsulfonates, 1,3-di[2-(hydroxyphenyl)-2-propyl] benzenes, bisphenolsulfones, and other color developers. Specific examples are given below.

bis-Phenol A compounds 4,4'-Isopropylidene diphenol (also called bisphenol A),
4,4'-cyclohexylidene diphenol, and
p,p'-(1-methyl-n-hexylidene)diphenol.

4-Hydroxybenzoates

Benzyl 4-hydroxybenzoate,
ethyl 4-hydroxybenzoate,
propyl 4-hydroxybenzoate,
isopropyl 4-hydroxybenzoate,
butyl 4-hydroxybenzoate,
isobutyl 4-hydroxybenzoate, and
methylbenzyl 4-hydroxybenzoate.

4-Hydroxyphthalic acid diesters

Dimethyl 4-hydroxyphthalate,
diisopropyl 4-hydroxyphthalate,
dibenzyl 4-hydroxyphthalate, and
dihexyl 4-hydroxyphthalate.

Phthalic acid monoesters

Monobenzyl phthalate,
monocyclohexyl phthalate,
monophenyl phthalate,
monomethylphenyl phthalate,
monoethylphenyl phthalate,
monoalkylbenzyl phthalates,
monohalobenzyl phthalates, and
monoalkoxybenzyl phthalates.

bis-(Hydroxyphenyl)sulfides bis-(4-Hydroxy-3-tert-butyl-6-methylphenyl)sulfide,
bis-(4-hydroxy-2,5-dimethylphenyl)sulfide,
bis-(4-hydroxy-2-methyl-5-ethylphenyl)sulfide,
bis-(4-hydroxy-2-methyl-5-isopropylphenyl)sulfide,
bis-(4-hydroxy-2,3-dimethylphenyl)sulfide,
bis-(4-hydroxy-2,5-diethylphenyl)sulfide,
bis-(4-hydroxy-2,5-diisopropylphenyl)sulfide,
bis-(4-hydroxy-2,3,6-trimethylphenyl)sulfide,
bis-(2,4,5-trihydroxyphenyl)sulfide,
bis-(4-hydroxy-2-cyclohexyl-5-methylphenyl)sulfide,
bis-(2,3,4-trihydroxyphenyl)sulfide,
bis-(4,5-dihydroxy-2-tert-butylphenyl)sulfide,
bis-(4-hydroxy-2,5-diphenylphenyl)sulfide, and
bis-(4-hydroxy-2-tert-octyl-5-methylphenyl)sulfide.

4-Hydroxyphenyl arylsulfones 4-hydroxy-4'-isopropoxydiphenylsulfone,
4-hydroxy-4'-methyldiphenylsulfone, and
4-hydroxy-4'-n-butyloxydiphenylsulfone.
4-Hydroxyphenyl arylsulfonates
4-Hydroxyphenyl benzenesulfonate,
4-hydroxyphenyl p-tolylsulfonate,
4-hydroxyphenyl mesitylenesulfonate,
4-hydroxyphenyl p-chlorobenzenesulfonate,
4-hydroxyphenyl p-tert-butylbenzenesulfonate,
4-hydroxyphenyl p-isopropoxybenzenesulfonate,
4-hydroxyphenyl 1'-naphthalenesulfonate, and
4-hydroxyphenyl 2'-naphthalenesulfonate.

1,3-Di[2-(hydroxyphenyl)-2-propyl]benzenes 1,3-Di[2-(4-hydroxyphenyl)-2-propyl]benzene,
1,3-di[2-(4-hydroxy-3-alkylphenyl)-2-propyl]benzene,
1,3-di[2-(2,4-dihydroxyphenyl)-2-propyl]benzene, and
1,3-di[2-(2-hydroxy-5-methylphenyl)-2-propyl]benzene.

Resorcinols 1,3-Dihydroxy-6(alpha,alpha-dimethylbenzyl)benzene.

4-Hydroxybenzoyloxybenzoic acid esters

Benzyl 4-hydroxybenzoyloxybenzoate,
methyl 4-hydroxybenzoyloxybenzoate,
ethyl 4-hydroxybenzoyloxybenzoate,
propyl 4-hydroxybenzoyloxybenzoate,
butyl 4-hydroxybenzoyloxybenzoate,
isopropyl 4-hydroxybenzoyloxybenzoate,
tert-butyl 4-hydroxybenzoyloxybenzoate,
hexyl 4-hydroxybenzoyloxybenzoate,
octyl 4-hydroxybenzoyloxybenzoate,
nonyl 4-hydroxybenzoyloxyenzoate,
cyclohexyl 4-hydroxybenzoyloxybenzoate,
beta-phenethyl 4-hydroxybenzoyloxybenzoate,
phenyl 4-hydroxybenzoyloxybenzoate,
alpha-naphthyl 4-hydroxybenzoyloxybenzoate,
beta-naphthyl 4-hydroxybenzoyloxybenzoate, and
sec-butyl 4-hydroxybenzoyloxybenzoate.

bisPhenolsulfones (I)

bis-(3-1-butyl-4-hydroxy-6-methylphenyl)sulfone,
bis-(3-ethyl-4-hydroxyphenyl)sulfone,
bis-(3-propyl-4-hydroxyphenyl)sulfone,
bis-(3-methyl-4-hydroxyphenyl)sulfone,
bis-(2-isopropyl-4-hydroxyphenyl)sulfone,
bis-(2-ethyl-4-hydroxyphenyl)sulfone,
bis-(3-chloro-4-hydroxyphenyl)sulfone,
bis-(2,3-dimethyl-4-hydroxyphenyl)sulfone,
bis-(2,5-dimethyl-4-hydroxyphenyl)sulfone,
bis-(3-methoxy-4-hydroxyphenyl)sulfone,
4-hydroxyphenyl-2'-ethyl-4'-hydroxyphenylsulfone,
4-hydroxyphenyl-2'-isopropyl-4'-hydroxyphenylsulfone,
4-hydroxyphenyl-3'-isopropyl-4'-hydroxyphenylsulfone,
4-hydroxyphenyl-3'-sec-butyl-4'-hydroxyphenylsulfone,
3-chloro-4-hydroxyphenyl-3'-isopropyl-4'-hydroxyphenylsulfone,
2-hydroxy-5-t-butylphenyl-4'-hydroxyphenylsulfone,
2-hydroxy-5-t-aminophenyl-4'-hydroxyphenylsulfone,
2-hydroxy-5-isopropylphenyl-4'-hydroxyphenylsulfone,
2-hydroxy-5-t-octylphenyl-4'-hydroxyphenylsulfone,
2-hydroxy-5-t-butylphenyl-3'-chloro-4'-hydroxyphenylsulfone,
2-hydroxy-5-t-butylphenyl-3,-methyl-4'-hydroxyphenylsulfone,
2-hydroxy-5-t-butylphenyl-3'-isopropyl-4'-hydroxyphenylsulfone,
2-hydroxy-5-t-butylphenyl-3'-chloro-4'-hydroxyphenylsulfone,
2-hydroxy-5-t-butylphenyl-3'-methyl-4'-hydroxyphenylsulfone,
2-hydroxy-5-t-butylphenyl-3'-isopropyl-4'-hydroxyphenylsulfone, and
2-hydroxy-5-t-butylphenyl-2'-methyl-4'-hydroxyphenylsulfone.

bisPhenolsulfones (II)

4,4'-Sulfonyldiphenol,
2,4'-sulfonyldiphenol,
3,3'-dichloro-4,4'-sulfonyldiphenol,
3,3'-dibromo-4,4'-sulfonyldiphenol,
3,3',5,5'-tetrabromo-4,4'-sulfonyldiphenol, and
3,3'-diamino-4,4'-sulfonyldiphenol.

Others p-tert-Butylphenol,
2,4-dihydroxybenzophenone,
novolak-type phenolic resins,
4-hydroxyacetophenone,
p-phenylphenol,
benzyl-4-hydroxyphenylacetate, and
p-benzylphenol.

Other organic color developers which can be used preferably in combination with the compound (I) include benzyl 4-hydroxybenzoate, 4-hydroxyphenyl 2'-naphthalenesulfonate, 1,3-di[2-(4-hydroxyphenyl)-2propyl]benzene, 1,3-dihydroxy-6(alpha,alpha-dimethylbenzyl) benzene and 4-hydroxy-4'-isopropoxydiphenylsulfone.

These color developers are used either singly or in combination. Preferred organic developers that can be used in accordance with this invention include, for example, 4,4'-isopropylidene diphenol, benzyl 4-hydroxybenzoate, 4-hydroxy-4'-isopropoxydiphenyl sulfone, and isobutyl-bis(4-hydroxyphenyl)acetate.

As suggested in the above-cited Japanese Laid-Open Patent Publication No. 144193/1981, benzyl 4-hydroxybenzoate can give a thermosensitive recording sheet of high sensitivity and excellent dynamic color developability when combined with a fluorane-type dye. But a thermosensitive recording sheet containing this color developer has the defect that the density of an image formed by application of heat is reduced with time or undergoes the "crystallization" phenomenon, and the image area does not have sufficient stability to oily substances. It has been found, however, that by using the compound of formula (I) together, the stability of the image is greatly increased.

The proportion of the color developer can be varied over a broad range depending upon the types of the dyes and the color developer. Advantageously, its amount is generally 3 to 12 parts by weight, preferably 2 to 4 parts by weight, more preferably 2.5 to 3.5 parts by weight, per part by weight of the basic leuco dye.

The color developer, the basic leuco dye and the compound of formula (I) are reduced to fine particles having a particle diameter of less than several microns by a grinding machine such as a ball mill, an attriter or a sand grinder, or a suitable emulsifying device, and according to the purpose for which the final product is used, a binder and various additives are added. The resulting coating composition is coated on a substrate such as paper or a plastic film, and dried to form a thermosensitive recording layer whose amount of coating is 4 to 10 g/m$^2$ (in a dry condition). As a result, the thermosensitive recording sheet of this invention can be obtained.

Suitable binders that can be used in this invention include, for example, completely saponified polyvinyl alcohol having a degree of polymerization of 200 to 1900, partially saponified polyvinyl alcohol, carboxy-modified polyvinyl alcohol, amide-modified polyvinyl alcohol, sulfonic acid-modified polyvinyl alcohol, butyral-modified polyvinyl alcohol, other modified polyvinyl alcohols, hydroxyethyl cellulose, methyl cellulose, carboxymethyl cellulose, styrene/maleic anhydride copolymer, styrene/butadiene copolymer, cellulose derivatives (e.g, ethyl cellulose and acetyl cellulose), polyvinyl chloride, polyvinyl acetate, polyacrylamide, polyacrylates, polyvinylbutyral, polystyrol, copolymers of these, polyamide resins, silicone resins, petroleum resins, terpene resins, ketone resins and coumarone resins. These polymeric binders can be used as solutions in water, alcohols, ketones, esters and hydrocarbons, or as emulsions or pastes dispersed in water or other media, according to the required qualities. The suitable amount of the binder is generally 8 to 20% by weight, preferably 9 to 15% by weight, more preferably 10 to 12% by weight.

The additive which can also be blended with the basic leuco dye, the color developer and the compound of formula (I) may be those which are used in conventional thermosensitive recording sheets. Examples include inorganic or organic fillers such as fine particles of clay, talc, silica, magnesium carbonate, alumina, aluminum hydroxide, magnesium hydroxide, barium sulfate, kaolin, titanium oxide, zinc oxide, calcium carbonate, aluminum oxide, urea, formalin resins, polystyrene and phenol resins, which are used usually in paper finishing; mold-releasing agents such as fatty acid metal salts; lubricants for preventing pressure coloration, such as fatty acid amides, ethylene bisamide, montan waxes and polyethylene waxes; dispersing agents such as sodium hexametaphosphate, sodium polycarboxylates, sodium dioctylsulfosuccinate, sodium dodecylbenzenesulfonate, sodium laurate, sodium salt of lauryl sulfate and alginate; ultraviolet absorbers such as benzophenone compounds and trioxazole compounds; water proofing agents such as glyoxal; defoamers such as acetylene glycol; fluorescent bleaching agents; and stabilizers such as phthalic acid monoester metal salts, p-tertiary butylbenzoic acid metal salts and nitrobenzoic acid metal salts. The amounts of these additives are determined depending upon the properties required of the product, its recording suitability, etc., and are not particularly restricted. As tentative standards, the amount of the fillers is, for example, 1 to 20 parts by weight per part by weight of the leuco dye. The other components may be used in amounts normally used.

The characteristics and advantages of the thermosensitive recording sheet of this invention are as follows:

(1) Because of its excellent thermal response characteristics, it can give clear images of high density even in high-speed high-density recording.

(2) The recorded images have excellent long-term storage stability, and particularly are free from color fading by moisture, heat, etc.

(3) It is substantially free from backgrounding with time.

The following examples illustrate the present invention more specifically. All parts in these examples are by weight.

SYNTHESIS EXAMPLE 1

A mixture of 15.3 g of p-phenylphenol, 6.2 g of potassium hydroxide, 15.4 g of p-bromotoluene and 0.4 g of copper powder was reacted at 280° C. for 4 hours. After the reaction, the reaction mixture was cooled to room temperature, and 60 ml of water was added. The mixture was extracted with toluene several times. Toluene was evaporated under reduced pressure from the toluene layer, and the residue was recrystallized from toluene-heptane to give 18.7 g (yield 80%) of 4-biphenyl-p-tolyl ether as white crystals (melting point 96° to 98° C.).

EXAMPLE 1

| EXAMPLE 1 | |
|---|---|
| Dispersion A (dye dispersion) | |
| 3-Diethylamino-6-methyl-7-anilino-fluorane | 2.0 parts |
| 10% Aqueous solution of polyvinyl alcohol | 4.6 parts |
| Water | 2.5 parts |
| Dispersion B (color developer dispersion) | |
| bisphenol A | 6.0 parts |
| Zinc stearate | 0.5 parts |
| 10% Aqueous solution of polyvinyl alcohol | 30.0 parts |
| Dispersion C (sensitizer dispersion) | |
| 4-Biphenyl p-tolyl ether | 4.0 parts |
| 10% Aqueous solution of polyvinyl alcohol | 5.0 parts |
| Water | 3.0 parts |

Each of the dispersions A to C was milled to a particle diameter of 3 microns by an attriter. The dispersions were then mixed in accordance with the following formulation to form a coating composition.

Dispersion A: 9.1 parts
Dispersion B: 36.5 parts
Dispersion C: 12.0 parts
Kaolin clay (50% dispersion): 20.0 parts The coating composition was applied to one surface of a sheet of base paper having a basis weight of 50 g/m$^2$ at a rate of 6.0 g/m$^2$, and the coated sheet was dried. The sheet was then treated with a supercalender so that its degree of smoothness became 200 to 800 seconds to form a thermosensitive recording sheet.

COMPARATIVE EXAMPLES 1-11

| COMPARATIVE EXAMPLES 1-11 | |
|---|---|
| Dispersion D (sensitizer dispersion) | |
| Sensitizer (see Table 1) | 4.0 parts |
| 10% Aqueous solution of polyvinyl alcohol | 5.0 parts |
| Water | 3.0 parts |

In each run, a thermosentitive recording sheet was prepared as in Example 1 except that the dispersion D, treated by an attriter, was used instead of the dispersion C.

The properties of the thermosensitive sheets obtained in the foregoing Example and Comparative Examples, and the results are summarized in Table 1.

TABLE 1

| Ex. (Example) or CEx. (Comparative Example) | Sensitizer | Image Density Static (*1) | Image Density Dynamic (*2) | Stability of the recorded image (*3) Non-treated | Stability of the recorded image (*3) Moisture resistance (*4) | Stability of the recorded image (*3) Heat resistance (*5) | Stability of the background (*6) Non-treated | Stability of the background (*6) Moisture resistance (*7) | Stability of the background (*6) Heat resistance (*8) |
|---|---|---|---|---|---|---|---|---|---|
| Ex. 1 | 4-biphenyl p-tolyl ether | 1.39 | 1.26 | 1.26 | 1.28 | 1.27 | 0.05 | 0.07 | 0.09 |
| CEx. 1 | 1-phenoxy-2-p-ethylphenoxyethane | 1.05 | 0.98 | 0.98 | 0.96 | 0.88 | 0.06 | 0.10 | 0.23 |
| CEx. 2 | 1-p-biphenyloxy-2-phenylethane | 1.04 | 0.97 | 0.97 | 0.95 | 0.87 | 0.07 | 0.11 | 0.21 |
| CEx. 3 | 2-benzyloxynaphthanene | 1.06 | 0.99 | 0.99 | 0.96 | 0.90 | 0.07 | 0.12 | 0.24 |
| CEx. 4 | 2-phenoxyacetyloxynaphthalene | 1.07 | 1.00 | 1.00 | 0.98 | 0.91 | 0.06 | 0.10 | 0.22 |
| CEx. 5 | 1-hydroxy-2-phenoxycarboxynaphthalene | 1.04 | 0.97 | 0.97 | 0.95 | 0.90 | 0.07 | 0.10 | 0.23 |
| CEx. 6 | 2-benzoyloxynaphthalene | 1.06 | 0.99 | 0.99 | 0.97 | 0.89 | 0.06 | 0.11 | 0.22 |
| CEx. 7 | 1-p-biphenyloxy-2-chloroethane | 1.05 | 0.98 | 0.98 | 0.96 | 0.87 | 0.08 | 0.12 | 0.23 |
| CEx. 8 | 2-beta-naphthaloxycarbonylphenol | 1.06 | 1.00 | 1.00 | 0.97 | 0.90 | 0.07 | 0.12 | 0.24 |
| CEx. 9 | 1,4-bisphenoxybutane | 1.05 | 0.99 | 0.99 | 0.96 | 0.81 | 0.07 | 0.11 | 0.23 |
| CEx. 10 | benzyl p-benzyloxybenzoate | 1.00 | 0.95 | 0.95 | 0.93 | 0.85 | 0.06 | 0.10 | 0.20 |
| CEx. 11 | dibenzyl terephthalate | 1.03 | 1.01 | 1.01 | 0.88 | 0.70 | 0.07 | 0.12 | 0.24 |

Note to Table 1

(*1): Static image density

The recording sheet was pressed against a hot plate heated at 105° C. under a pressure of 10 g/cm$^2$ for 5 seconds, and the density of the formed color was measured by a Macbeth densitometer.

(*2): Dynamic image density

The density of an image recorded on the recording sheet at an applied voltage of 16.5 V with a pulse width of 1.00 millisecond using a thermosensitive print tester (THP8050 made by ROHM) was measured by a Macbeth densitometer.

(*3): Stability of the recorded image

The density of an image recorded at an applied voltage of 18.03 V with a pulse width of 3.2 milliseconds by a thermosensitive facsimile device (KB-4800 made by Tokyo Shibaura Electric Co., Ltd.) was measured by a Macbeth densitometer.

(*4): Moisture resistance of the recorded image

The image density measured after standing highly humid conditions involving 40° C. and an RH of 90% for 24 hours.

(*5): Heat resistance of the recorded image

Image density measured after standing under high-temperature drying conditions involving 60° C. for 24 hours.

(*6): Stability of the background

The optical density of an uncolored portion of the recording sheet was measured by a Macbeth densitometer.

(*7): Moisture resistance of the background

The recording sheet was left to stand under highly humid conditions involving 20° C. and 90% RH for 24 hours, and then the density of the background was measured.

(*8): Heat resistance of the background

The recording sheet was left to stand under high-temperature drying conditions at 60° C. for 24 hours, and the density of the background was measured.

We claim:

1. A thermosensitive recording sheet comprising a support and a thermosensitive color developer layer thereon containing a basic leuco dye and an organic color developer, said layer containing a compound of the formula

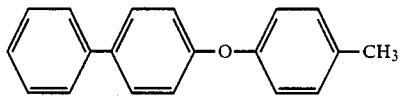

(I)

as a sensitizer.

2. The thermosensitive recording sheet of claim 1 wherein the amount of the compound of formula (I) is 0.1 to 10 parts by weight per part by weight of the basic leuco dye.

3. The thermoplastic recording sheet of claim 2 wherein the amount of the compound of formula (I) is 1 to 5 parts by weight per part by weight of the basic leuco dye.

4. The thermosensitive recording sheet of claim 1 wherein the basic leuco dye is selected from triphenylmethane-type dyes, fluorane-type dyes and azaphthalide-type dyes.

5. The thermosensitive recording sheet of claim 4 wherein the basic leuco dye is a mixture of 3-diethylamino-6-methyl-7-anilinofluorane and 3-(N-cyclohexyl-N-methylamino)-6-methyl-7-anilinofluorane.

6. The thermosensitive recording sheet of claim 1 wherein the basic leuco dye is selected from 3-diethylamino-6-methyl-7-anilinofluorane, 3-(N-cyclohexyl-N-methylamino)-6-methyl-7-anilinofluorane, 3-(N-ethyl-N-isoamyl)amino-6-methyl-7-anilinofluorane and 3-(4-diethylamino-2-ethoxyphenyl)-3-(1-ethyl-2-methylindol-3-yl)-4-azaphthalide.

7. The thermosensitive recording sheet of claim 1 wherein the organic color developer is selected from 4,4'-isopropylidene diphenol, benzyl 4-hydroxybenzoate, 4-hydroxy-4'-isopropoxydiphenylsulfone and isobutyl-bis-(4-hydroxyphenyl)acetate.

* * * * *